US005168580A

United States Patent [19]

Foo

[11] Patent Number: 5,168,580

[45] Date of Patent: Dec. 8, 1992

[54] JACKET WITH CHANGEABLE ATTACHMENTS

[76] Inventor: Ian Foo, 150 Linden St., Oakland, Calif. 94607

[21] Appl. No.: 749,843

[22] Filed: Aug. 23, 1991

[51] Int. Cl.[5] ..... A41B 1/08

[52] U.S. Cl. ..... 2/115; 2/244; 2/247

[58] Field of Search ..... 2/69, 85, 93, 108, 115, 2/122, 244, 246, 247, DIG. 6

[56] References Cited

U.S. PATENT DOCUMENTS

| | | | |
|---|---|---|---|
| 2,439,097 | 4/1948 | Pierce | 2/247 |
| 2,647,261 | 8/1953 | Rassner | 2/93 |
| 3,137,860 | 6/1964 | Bindler | 2/115 |
| 3,484,974 | 12/1969 | Culmone | 2/93 |
| 3,624,686 | 11/1971 | Beals | 2/DIG. 6 |
| 3,724,101 | 4/1973 | Slezak | 2/69 |
| 4,218,781 | 8/1980 | Lieberman | 2/247 |
| 4,249,268 | 2/1981 | Berler | 2/115 |
| 4,277,848 | 7/1981 | Boehland | 2/115 |
| 4,513,454 | 4/1985 | Anderson | 2/246 |
| 4,611,355 | 9/1986 | Galanto | 2/246 |
| 4,776,043 | 10/1988 | Coleman | 2/244 |
| 4,875,237 | 10/1989 | Cohen | 2/115 |
| 5,052,056 | 10/1991 | Braun | 2/115 |
| 5,054,127 | 10/1991 | Zevchak | 2/247 |
| 5,086,516 | 2/1992 | Baxter | 2/246 |

FOREIGN PATENT DOCUMENTS

| | | | |
|---|---|---|---|
| 2486369 | 1/1982 | France | 2/69 |

*Primary Examiner*—Werner H. Schroeder
*Assistant Examiner*—Diana L. Biefeld
*Attorney, Agent, or Firm*—Lee W. Tower

[57] ABSTRACT

An attractive jacket design having removable and changable panels that has the overall effect of lowering the cost of sport jackets. With this invention, chest, shoulder and back panels on the jacket are easily removable and changeable in order to allow a user of the jacket to use one set of patches with the jacket for one purpose or event and to remove those patches from the jacket and put another set of patches on the jacket for another purpose or event, which permits the manufacture of a set of patches for various teams rather than a set of jackets, thus reducing overall manufcturing cost.

2 Claims, 2 Drawing Sheets

FIG. 3
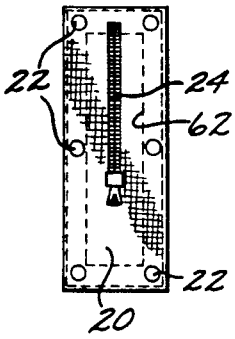
FIG. 4
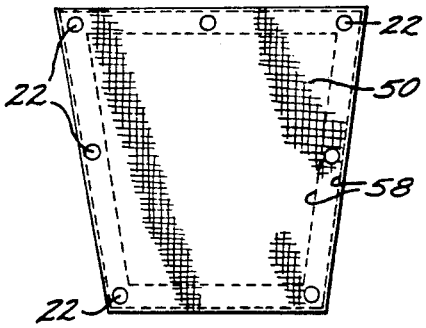
FIG. 5
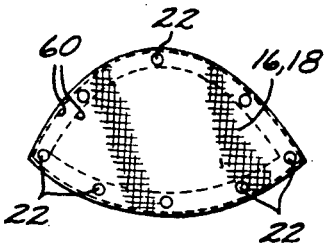
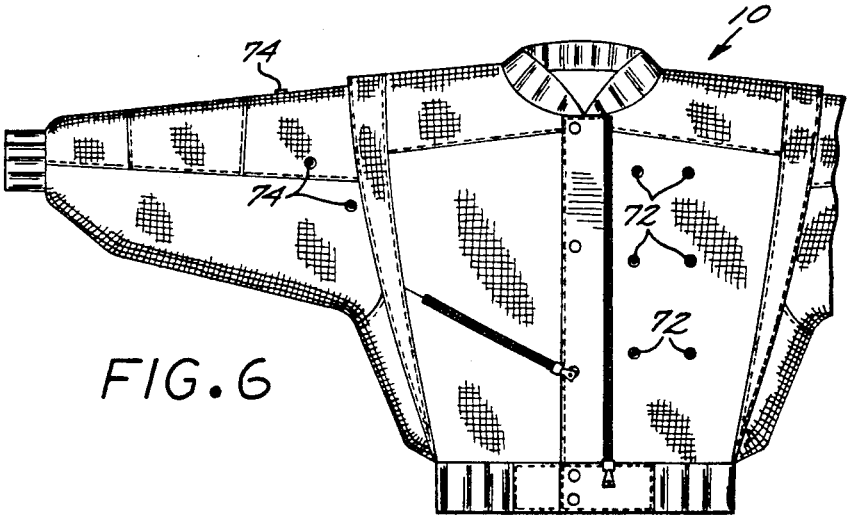
FIG. 6
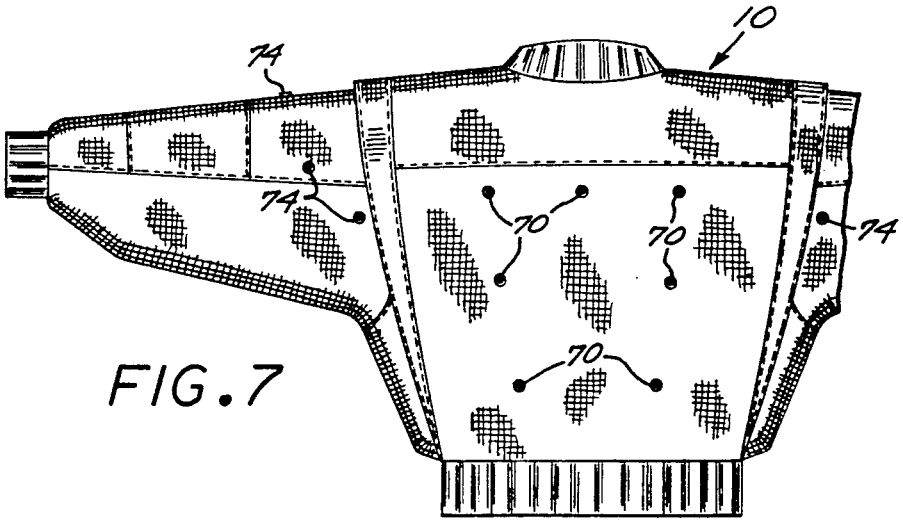
FIG. 7

JACKET WITH CHANGEABLE ATTACHMENTS

BACKGROUND OF THE INVENTION

1. Field of the Invention

This invention relates to clothing and in particular to sport jackets that are worn to represent various entities, such as sport teams and schools.

2. Prior Art

In the prior art there are many jackets designs. In particular for sporting jackets associated with professional basketball, baseball and football teams, such as the National Basketball Association (NBA), it is common to have patches of various types permanently attached to the jacket. These patches have, for example, the name and emblem for the team and are sewed to the shoulders, chest and back of the jacket. There are many teams in each sport and many sports, especially when one considers all the school teams, all the amateur teams and all the professional teams. The result is that the manufacture of sports jackets for teams is a very custom manufacturing endeavor with few economies of scale. Buyers of a team customized jacket, generally would only wear that jacket in association with the events related to the manner in which the jacket has been customized. For example, suppose the jacket was customized to represent the Los Angeles Lakers NBA team. Then the user of the jacket would be unlikely to want to use the jacket to go to a Los Angeles RAMs National Football League game. So in the present state of the art, the buyer not only pays more for the jacket, because of inefficient economies of scale for the manufacturer, but also the customer has a limited venue for use. Of course, compounding the economy of scale problem is the sheer number of sizes and styles that must be manufactured to accommodate everyone's size and taste. These latter problems are common to all clothing and are not addressed by the present invention. In any event, the overall impact is that the price of such jackets presently is relatively high.

SUMMARY OF THE INVENTION

The object of the present invention is an attractive jacket design having removable and changable panels that has the overall effect of lowering the cost of sport jackets. With this invention, chest, shoulder and back panels are easily removable and changable in order to allow customization from one team to another team.

The invention employs snaps to attach the removable panels; however, it is also possible to employ other attachment means such as velcro and the like.

An object of the invention is to reduce the cost of sport jackets with patches. Another object is to allow a user of the jacket to use one set of patches with the jacket for one purpose or event and to remove those patches from the jacket and put another set of patches on the jacket for another purpose or event. Another object is to permit the manufacture of a set of patches for various teams rather than a set of jackets, thus reducing overall manufacturing cost.

Another object is to allow the attachment of custom panels which can have storage capability. Another object is to allow the attachment of panels with strictly a decorative function, which can be changed over time to meet current fashions.

BRIEF DESCRIPTION OF THE DRAWINGS

A better understanding of the invention and its advantages will be apparent from the detailed description taken in conjunction with the accompanying drawings in which:

FIG. 3 is a front elevation view of a removable chest panel with a storage pocket of the present invention.

FIG. 4 is a front elevation view of a removable back panel of the present invention.

FIG. 5 is a front elevation view of a removable sleeve cap panel of the present invention.

FIG. 6 is a front elevation view of a jacket of the present invention with the removable chest and sleeve cap panels removed exposing snap attachments on the jacket.

FIG. 7 is a rear elevation view of a jacket of the present invention with the removable back panel removed exposing snap attachments on the jacket.

DESCRIPTION OF THE PREFERRED EMBODIMENTS

Figure 1:
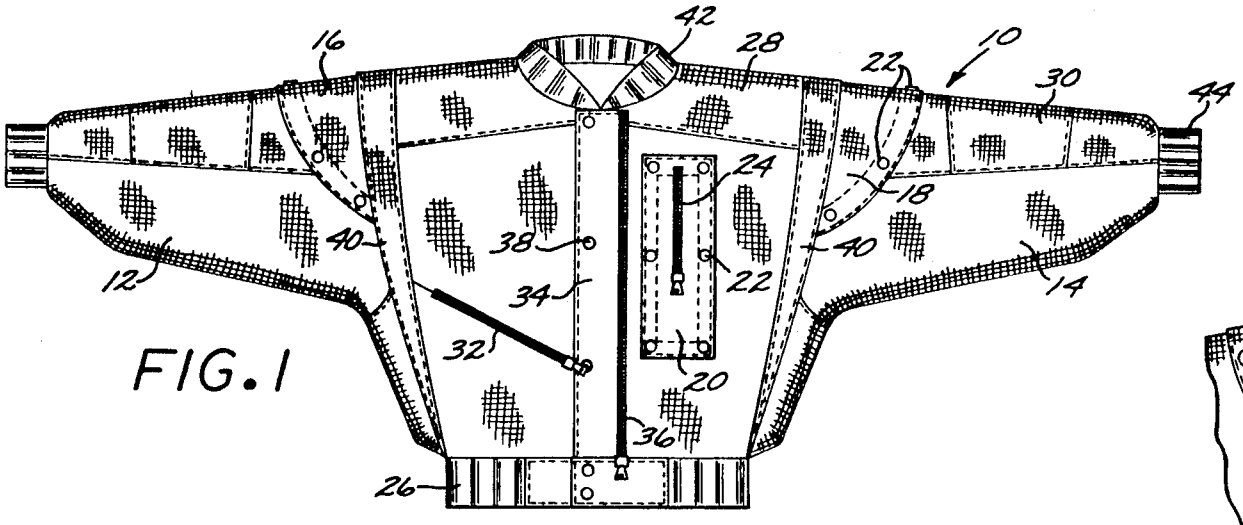
FIG. 1 is a front elevation view of a jacket of the present invention showing removable chest and sleeve cap panels attached.

Referring now to the drawings, and more particularly, to FIG. 1, there is shown a jacket with removable attachments 10. The jacket shell can be manufactured of wool, acrylic, leather or denim to name some of the common materials. These materials can be mixed as desired to provide contrast and achieve a particular fashion. The rib trim can be made of 100% acrylic and the lining of the jacket can be insulated rayon acetate satin. The stitching of the jacket can be a body safety stitch for all major body seams and a topstitch for other areas of the jacket, such as the shoulder yoke, the center front placket and zipper, the waistband, the armhole flange, the sleeves, the sleeve cuffs and the collar. This is all common to the state of the art.

As shown in FIG. 1, the jacket with removable attachments 10 has a right sleeve 12 with a removable right sleeve cap panel 16 and a left sleeve 14 with a removable left sleeve cap panel 18. A removable chest pocket 20, which has an exposed zipper 24 for access to a pocket, is shown on the front of the jacket. The removable right sleeve cap panel 16, removable left sleeve cap panel 18 and removable chest pocket 20 are attached to the jacket with snaps 22. The back facing for the removable panels can be cotton sheeting.

Other features of the jacket include a rib waistband 26. Contrasting shoulder yoke 28 and elbow panel 30 improve the appearance of the jacket and can be a different color or material than the rest of the jacket shell. A diagonal zipper pocket 32 lined with cotton sheeting can be placed on the side opposite to the removable chest pocket 20 and is shown on the right side of the jacket. The zippers throughout the jacket can be Delrin brand zippers. The jacket has a center front placket with snap top closure 34, which conceals zipper 36 and is itself fastened with snaps 38. Interlining for the center front placket, as well as for the waistband, the armhole flanges, and the removable attachment pieces can be Pellon (Ax-cel 520).

A folded armhole flange 40 on the left and the right can be used to improve the appearance of the jacket, but also to provide a slight overlap of material over the top of both removable right sleeve cap panel 16 and removable left sleeve cap panel 18. This effectively hides the top attachment points (snaps) of both removable right sleeve cap panel 16 and removable left sleeve cap panel 18. The collar 42 and cuff 44 can be made of rib knit.

Figure 2:
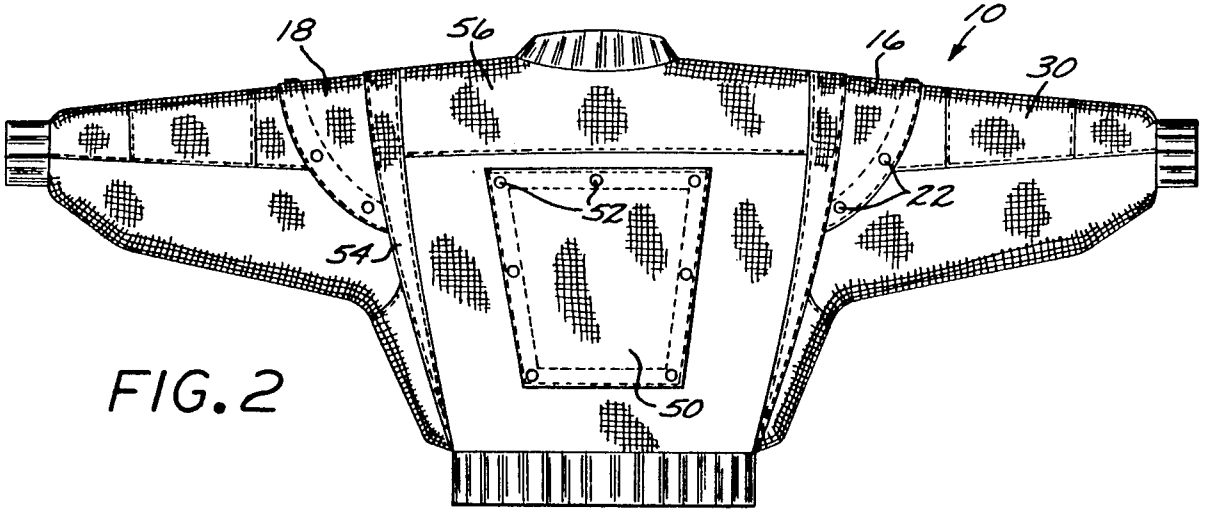
FIG. 2 is a rear elevation view of a jacket of the present invention.

FIG. 2 shows the rear of a jacket with removable attachments 10, which shows removable back panel 50. Snaps 52 attach the removable back panel 50. In the rear view also is shown folded armhole flange 54, which is an extension of folded armhole flange 40. The back shoulder yoke 56 is an extension of shoulder yoke 28.

The removable chest pocket 20 is shown in detail in FIG. 3. Six snaps 22 are placed around the perimeter of the removable chest pocket 20 arranged in two parallel vertical rows of three snap attachments each, with each snap providing a discrete attachment point permanently attached to the removable chest pocket. A pocket in the removable chest pocket 20 is formed by stitching 62, and is accessible by zipper 24. The pocket can be lined with cotton sheeting.

The removable back panel 50 is shown in detail in FIG. 4. Seven snaps 22 are placed around its perimeter and stitching 58 is used in the removable back panel 50. The set of seven snaps on the removable back panel 50 are arranged in a trapezoid, with each snap providing a discrete attachment point permanently attached to the removable back panel.

The removable right sleeve cap panel 16 and/or removable left sleeve cap panel 18, shown in FIG. 5, has a shape proper for shoulder patches and has snaps 22 around its perimeter. The stitching 60 helps define the shape of the patch.

FIG. 6 shows a front view of the jacket with the patches removed. As a result the permanent attachment points such as snap attachments 72 for a removable chest panel and snap attachments 74 for a removable sleeve cap panel are visible in FIG. 6. The snap attachments 72 for a removable chest panel, shown in FIG. 6, are arranged in two parallel vertical rows of three snap attachments each permanently mounted on the front of the jacket, with each snap providing a discrete permanent attachment point. The removable chest panel could be a removable chest pocket 20 as shown in FIG. 3 or just a patch with an emblem of a team or school, for example.

FIG. 7 shows the rear view of the jacket with the patches removed 70 for a removable back panel and snap attachments 74 for a removable sleeve cap panel. The snap attachments 70 for a removable back panel provide a set of discrete attachment points arranged in a trapezoid with two sides parallel with the back shoulder yoke 56 of the jacket with the longer parallel side of the trapezoid facing the neck of jacket.

The various attachment points are permanently attached to the jacket and cannot be removed. These attachment points are not necessarily attractive by themselves and therefore the user is motivated to attach the removable panels representing some entity. It is relatively easy to apply a removable chest pocket 20, a removable right sleeve cap panel 16, a removable left sleeve cap panel 18, and a removable back panel 50 to customize the appearance of the jacket. Of course, it is not necessary to attach removable panels to all of the attachment points. A wide selection of removable panels would be made available to the jacket owner to buy at a reasonable price, because it is very economical to make the custom removable panels.

Figure 8:
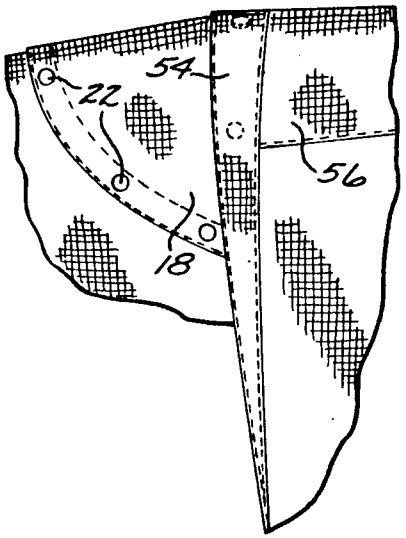
FIG. 8 is a detailed view of a folded armhole flange of a jacket of the present invention.

FIG. 8 shows a detail of folded armhole flange 54 and how it overlaps removable sleeve cap panel 18 and some of the snaps 22 on the sleeve cap panel 18.

It is thought that the jacket with changable attachments of the present invention and many of its attendant advantages will be understood from the foregoing description and it will be apparent that various changes may be made in the form, construction and arrangement of the parts thereof and in the methods used without departing from the spirit and scope of the invention or sacrificing all of its material advantages, the forms hereinbefore described being merely a preferred or exemplary embodiments thereof.

I claim:

1. A system for a jacket with changeable attachments that comprises:

two parallel vertical rows of three discrete attachment points each, permanently mounted on the front chest of said jacket;

a chest panel removably attachable to said two parallel vertical rows of three discrete attachment points on said front chest of said jacket by a mating set of two parallel vertical rows of three discrete attachment points permanently mounted on said chest panel;

a set of discrete attachment points permanently mounted to the back of said jacket arranged in a trapezoid with two sides parallel with the back shoulder yoke of said jacket and with the longer parallel side of the trapezoid facing the neck of said jacket;

a back panel removably attachable to said set of discrete attachment points on said back of said jacket arranged in a trapezoid by a mating set of discrete attachment points arranged in a trapezoid and permanently mounted to said back panel;

a let folded armhole flange mounted to said jacket and overlapping the left shoulder of said jacket;

a right folded armhole flange mounted to said jacket and overlapping the right shoulder of said jacket;

a left set of discrete attachment points permanently mounted on said left shoulder of said jacket wherein some of said set of discrete attachment points are overlapped by said left folded armhole flange;

a right set of discrete attachment points permanently mounted on said right shoulder of said jacket wherein some of said set of discrete attachment points are overlapped by said right folded armhole flange;

a left shoulder panel removably attachable to said set of discrete attachment points permanently mounted on said left shoulder by a mating set of discrete attachment points permanently mounted to said left shoulder panel; and a right shoulder panel removably attachable to said set of discrete attachment points permanently mounted on said right shoulder by a mating set of discrete attachment points permanently mounted to said right shoulder panel.

2. The system of claim 1 for a jacket with changeable attachments wherein said chest panel further comprises a pocket having a fastener for said pocket.

* * * * *